US008556606B2

(12) United States Patent
Noguchi

(10) Patent No.: US 8,556,606 B2
(45) **Date of Patent: *Oct. 15, 2013**

(54) WATER INJECTION TYPE SCREW FLUID MACHINE

(75) Inventor: Toru Noguchi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 3 days.

This patent is subject to a terminal disclaimer.

(21) Appl. No.: 13/398,097

(22) Filed: Feb. 16, 2012

(65) Prior Publication Data

US 2012/0230857 A1 Sep. 13, 2012

(30) Foreign Application Priority Data

Mar. 11, 2011 (JP) ..... 2011-053794

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.

USPC ..... 418/98; 418/201.1; 418/102; 418/104; 418/141; 418/270; 277/351; 277/303

(58) Field of Classification Search

USPC ..... 418/98, 101, 102, 104, 140, 141, 201.1, 418/206.1–206.8, 270; 277/351, 303, 412, 277/562

See application file for complete search history.

(56) References Cited

U.S. PATENT DOCUMENTS

| | | | | |
|---|---|---|---|---|
| 3,556,697 | A * | 1/1971 | Webb et al. | 418/98 |
| 3,975,123 | A * | 8/1976 | Schibbye | 418/102 |
| 5,641,280 | A * | 6/1997 | Timuska | 418/102 |
| 6,095,780 | A * | 8/2000 | Ernens | 418/104 |
| 6,174,148 | B1 | 1/2001 | Suzuki | 418/1 |
| 6,287,100 | B1 * | 9/2001 | Achtelik et al. | 418/104 |
| 7,713,040 | B2 * | 5/2010 | Kimura et al. | 418/104 |
| 2004/0086396 | A1 * | 5/2004 | De Smedt et al. | 417/410.4 |
| 2012/0164015 | A1 | 6/2012 | Yoshimura et al. | |
| 2012/0201710 | A1 | 8/2012 | Noguchi | |
| 2012/0230857 | A1 * | 9/2012 | Noguchi | 418/201.1 |

FOREIGN PATENT DOCUMENTS

| | | | |
|---|---|---|---|
| JP | 07317553 | A * | 12/1995 |
| JP | 2000-45948 | | 2/2000 |
| JP | 2007132243 | A * | 5/2007 |
| JP | 4559343 | | 7/2010 |

* cited by examiner

*Primary Examiner* — Theresa Trieu

(74) *Attorney, Agent, or Firm* — Oblon, Spivak, McClelland, Maier & Neustadt, L.L.P.

(57) ABSTRACT

A screw fluid machine has a first non-contact seal, a second non-contact seal and a lip seal disposed between a rotor chamber and a bearing for a rotor shaft located on the high pressure side, and in this order from the rotor chamber side. It includes a pressurized communicating channel for introducing high-pressure target gas into a pressurized space formed between the first and second non-contact seals, a pressurized pressure detecting device for detecting the pressure of the pressurized space, and an alarm device for generating an alarm when a value detected by the pressurized pressure detecting device falls out of a predefined range of pressurized pressures. The screw fluid machine is capable of detecting or predicting a condition of the shaft sealing device and accurately and reliably reporting the detected condition to an operator.

6 Claims, 3 Drawing Sheets

WATER INJECTION TYPE SCREW FLUID MACHINE

BACKGROUND OF THE INVENTION

1. Field of the Invention

The present invention relates to water injection type screw fluid machines.

2. Description of the Related Art

In a screw fluid machine, such as a screw compressor for compressing a target gas by means of intermeshing male and female screw rotors housed in a rotor chamber, or a screw expander (an expansion apparatus), in which the target gas is expanded to rotate the intermeshing male and female screw rotors in the rotor chamber, a shaft sealing structure is provided between a rotor shaft of the screw rotor and a bearing to seal the target gas in a system or prevent the target gas from being mixed with outside air or the like.

In conventional screw compressors as described in Japan Patent No. 4559343, a lip seal is used as a shaft sealing device on the intake side, while a mechanical seal is used as a shaft sealing device on the discharge side.

Although the lip seal is an inexpensive and space-saving shaft sealing device, the maximum pressure which can be sealed by the lip seal is typically around 0.3 kgf/cm$^2$. For this reason, since the lip seal could have an insufficient shaft sealing effect or tend to be significantly inferior in durability when used on the high pressure side, the lip seal can be only used to seat a shaft on the low pressure side. On the other hand, the mechanical seal, which is capable of sealing a shaft on the high pressure side, is problematic in terms of its extremely high cost and large footprint.

In the screw compressor disclosed in the above noted Japan Patent No. 4559343, the lip seals are used for sealing a shaft on the intake side and also used for sealing the shaft on the discharge side. In order to prevent application of an excessive pressure on the lip seals, which are used for sealing the shaft on the discharge side, the screw compressor is equipped with a labyrinth seal disposed between a screw rotor and the lip seals, and a communicating channel for allowing a space between the labyrinth seal and the lip seals to be communicated with an intake channel or an intermediate pressure section, located close to the intake side, in the rotor chamber.

On the other hand, as described in JP 2000-45948-A, for example, some screw fluid machines are of a water injection type that water is injected into a rotor chamber for the purposes of lubrication and cooling. When the lip seal is used as the shaft sealing device in such a screw fluid machine of the water injection type, it is necessary for the lip seal to have a water sealing function. However, because lubrication property of water is poor as contrasted to oil, the lip seal becomes more vulnerable to abrasion when it is used for sealing water. Therefore, such a water injection type screw fluid machine suffers from a problem that the lip seal has a short service life, necessitating frequent maintenance.

Thus, the screw fluid machines, in particular, those of the water injection type should be equipped with a shaft sealing device capable of extending the life of the lip seal. It is also necessary that when any abnormal condition occurs on the shaft sealing device or when any abnormal condition is predicted to occur, the abnormal condition is reported to an operator of a water injection type screw fluid machine in an accurate and reliable way for urging the operator to perform appropriate maintenance on the screw fluid machine of the water injection type.

SUMMARY OF THE INVENTION

In view of the problems set forth above, the present invention advantageously provides a water lubrication type screw fluid machine, in which a shaft sealing device has a long life, and a condition of the shaft sealing device can be detected or predicted to accurately and suitably inform an operator of the condition.

In order to overcome the above problems, a water injection type screw fluid machine according to the present invention includes: a casing in which a rotor chamber is formed; intermeshing male and female screw rotors housed in the rotor chamber to compress a target gas or convert expansion force of the target gas into turning force; a water supplying mechanism for injecting water into the rotor chamber to lubricate the screw rotors; a first non-contact seal, a second non-contact seal, and a lip seal, which are disposed between the rotor chamber and a bearing for a rotor shaft of the screw rotor and in this order from the rotor chamber side; and a pressurized communicating channel for introducing the target gas which is at high pressure into a pressurized space formed between the first non-contact seal and the second non-contact seal.

According to the above-described structure, a pressure of the pressurized space is increased by introducing the target gas whose pressure is increased through the high pressure communicating channel. In this way, because the pressure of the pressurized space is maintained at high pressure, water that leaks out of the rotor chamber into an outflow space is not allowed to flow into the pressurized space. This can prevent the water that leaks out of the rotor chamber into the outflow space from arriving at the lip seal, which can, in turn, protect the lip seal against damage, and avoid a leak of a lubricating oil for the bearing from being caused by the entry of water into the lip seal.

Further, the thus-configured screw fluid machine may further include a pressurized pressure detecting device for detecting a pressure of the pressurized space or the pressurized communicating channel; and an alarm device for generating an alarm when a value detected by the pressurized pressure detecting device falls out of a predefined range of pressurized pressures.

According to the above-described structure, the pressure of the pressurized space, which is highly likely to change when any abnormal condition occurs on the shaft sealing machine, is detected by the pressurized pressure detecting device. Then, in the event that an abnormal increase or decrease in pressure is detected, because an alarm device generates the alarm to provide an operator of the water injection type screw fluid machine with information about the event, the operator of the water injection type screw fluid machine can be prompted to perform appropriate maintenance.

Further, the thus-configured screw fluid machine may be a screw compressor for compressing the target gas; further include a water recovery unit for separating the water from the target gas that is discharged; and supply the target gas, from which the water is separated in the water recovery unit, through a pressure reducing means to the pressurized communicating channel.

According to the above structure, a part of the target gas discharged from the water injection type screw compressor can be reused as the target gas to be introduced into the pressurized space, which can eliminate the necessity to provide an additionally attached facility for supplying the target gas to the pressurized communicating channel. Furthermore, the abnormal condition of the shaft sealing device can be detected by finding a fact that the value detected by the pressurized pressure detecting device increases or decreases beyond a limit above or below a setting value of the pressure reducing means.

Still further, in the screw fluid machine structured as described above, the bearing may be a bearing on the high pressure side, and the screw fluid machine may further include a low pressure communicating channel for allowing an outflow space, which is formed on the rotor chamber side with respect to the first non-contact seal, to be communicated with a low pressure space inside the rotor chamber or a low pressure channel for the target gas, which is in communication with the rotor chamber.

According to the above-described structure, the pressure of the outflow space is reduced by connecting the outflow space through the low pressure communicating channel to the rotor chamber or an intake channel whose pressure is lower than a discharge pressure, while the pressure of the pressurized space is increased by introducing the target gas whose pressure is increased through the pressurized communicating channel. In this way, because the pressure of the pressurized space is maintained at the pressure higher than that of the outflow space, the water leaked out of the rotor chamber into the outflow space is not allowed to flow into the pressurized space, and the water is circulated through the low pressure communicating channel into the rotor chamber. Thus, for the bearing and the lip seal on the high pressure side, the effects of protecting the lip seal against damage and preventing a leak of the lubricating oil for the bearing resulting from entry of the water into the lip seal can be sufficiently achieved.

Moreover, the thus-configured screw fluid machine may further include: a pressurized pressure detecting device for detecting a pressure of the pressurized space or the pressurized communicating channel; a low pressure detecting device for detecting a pressure of the low pressure space or the low pressure channel, which is in communication with the outflow space, the low pressure communicating channel, or the low pressure space; and an alarm device for generating an alarm when a pressure difference between a value detected by the pressurized pressure detecting device and a value detected by the low pressure detecting device falls out of a predefined pressure differential range.

According to the above-described structure, because occurrence of an abnormal condition of the first non-contact seal can be suitably sensed, a possibility that the leaked water arrives at the lip seal can be reduced further.

Furthermore, the thus-configured screw fluid machine may further include an open communicating channel, through which an open space, which is formed between the second non-contact seal and the lip seal, opens to an outside of the casing.

According to the above-described structure, even if water is introduced into the open space, damage which will be inflicted on the lip seal can be kept to a minimum because the introduced water is released through the open communicating channel to the atmosphere.

DESCRIPTION OF THE PREFERRED EMBODIMENTS

Figure 1:
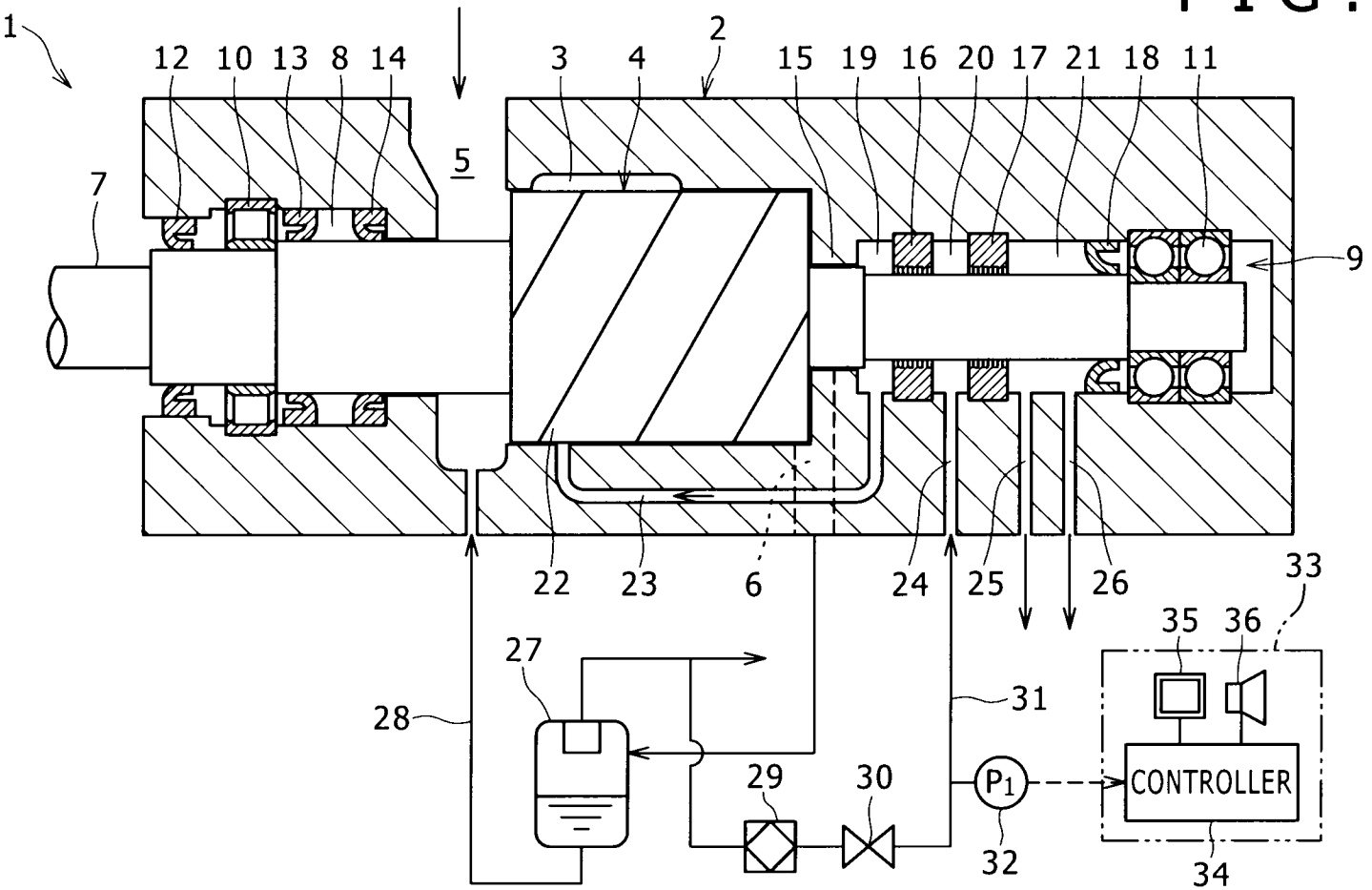
FIG. 1 is a simplified cross sectional diagram of a screw compressor according to a first embodiment of the present invention.

Hereinafter, embodiments of the present invention will be described with reference to the drawings. FIG. 1 schematically shows a water injection type screw compressor 1 which is a first embodiment of a water injection type screw fluid machine according to this invention. The screw compressor 1 functions to discharge a target gas (such as, for example, air) compressed by means of a pair of intermeshing male and female screw rotors 4 housed in a rotor chamber 3, which is formed inside a casing 2. Further, in the screw compressor 1, water is introduced into the rotor chamber 3 for cooling, sealing, and lubrication.

The casing 2 includes an intake channel (a low pressure channel) 5, which is in communication with the rotor chamber 3 to supply the rotor chamber 3 with the target gas to be compressed, a discharge channel 6, which is in communication with the rotor chamber 3 to discharge the target gas compressed in the rotor chamber 3 by the screw rotors 4, and shaft supporting and sealing spaces 8 and 9, which are formed to respectively receive structures for supporting and sealing a rotor shaft 7 of the screw rotor 4 on both an intake side and a discharge side.

The rotor shaft 7 is rotatably supported by both a roller bearing 10 installed in the shaft supporting and sealing space 8 on the intake side and two ball bearings 11 installed in the shaft supporting and sealing space 9 on the discharge side, and extended through the shaft supporting and sealing space 8 on the intake side so as to be connected to a motor, which is not illustrated.

In an area on the motor side with respect to the roller bearing 10, a lip seal 12 is installed to block foreign matter (such as a lubricating oil for the roller bearing 10) from penetrating the motor side. On the other hand, in an area on the screw rotor 4 side with respect to the roller bearing 10, a lip seal 13 is installed for sealing the area to block the lubricating oil for the roller bearing 10 from flowing toward a rotor chamber 3 side, while a lip seal 14 is installed for sealing the area to block the target gas or a lubricating fluid from penetrating a roller bearing 10 side from the intake channel 5.

A partitioning wall section 15 defining an end surface of the rotor chamber 3 on the discharge side (a high pressure side) is formed in the casing 2 to separate the rotor chamber 3 from the shaft supporting and sealing space 9 on the discharge side. Between the partitioning wall section 15 and the ball bearings 11 in the shaft supporting and sealing space 9 on the discharge side, a first non-contact seal 16, a second non-contact seal 17, and a lip seal 18 are installed in this order from the rotor chamber 3 side.

The first and second non-contact seals 16 and 17 are commonly-known labyrinth seals, which create a small clearance of approximately 0.02 mm between themselves and the rotor shaft 7 so that a high pressure loss of a fluid that is to pass through the clearance is caused, and passage of the fluid is suppressed. The lip seal 18 is placed in an orientation in which the lubricating oil for the ball bearings 11 can be prevented from leaking out toward the rotor chamber 3 side.

The first non-contact seal 16, the second non-contact seal 17, and the lip seal 18 divide the shaft supporting and sealing space 9 into respective spaces to create an outflow space 19 between the partitioning wall section 15 and the first non-contact seal 16, a pressurized space 20 between the first non-contact seal 16 and the second non-contact seal 17, and an open space 21 between the second non-contact seal 17 and the lip seal 18.

The casing 2 further includes a low pressure communicating channel 23 for allowing the outflow space 19 to communicate with a low pressure space 22, which is a space, isolated from the intake channel 5 of the rotor chamber 3, in the midstream of compression, a pressurized communicating channel 24 for introducing the target gas at high pressure into the pressurized space 20, and open communicating channels 25, 26 that communicate with the open space 21 and the outside of the casing 2 so that the open space 21 opens to the atmosphere.

In addition, the water injection type screw compressor 1 is further equipped with a water recovery unit 27, which separates water from the target gas discharged from the discharge channel 6, a water supply pipe 28, which re-supplies the water separated and recovered by the water recovery unit 27 into the intake channel 5, and a pressurized pipe 31, which introduces a part of the target gas from which water is removed by the water recovery unit 27 into the pressurized communicating channel 24 through a filter 29 and a regulator (a pressure reducing means) 30.

The regulator 30 is set up so as to reduce a pressure of the target gas almost to a pressure (a setting pressure) slightly higher than that of the low pressure space 22. For example, when the pressure of the low pressure space 22 is approximately 0.03 MPa, the pressurized space 20 is adjusted to be almost at a pressure (of 0.13 MPa) which is higher by approximately 0.1 MPa than the pressure of the low pressure space 22. It should be noted that, in addition to the regulator 30, another pressure reducing means, such as, for example, an orifice, may be installed in the pressurized pipe 31 between the regulator 30 and the pressurized space 20.

Moreover, the water injection type screw compressor 1 also includes a pressurized pressure detecting device 32 for detecting a pressure of the pressurized pipe 31, i.e. a pressure $P_1$ of the pressurized communicating channel 24 and thus the pressurized space 20. A value detected by the pressurized pressure detecting device 32 is input into an alarm device 33. The alarm device 33 includes a controller 34, in which the value detected by the pressurized pressure detecting device 32 is input, and whether or not the detected value having been input falls within a predetermined range of pressurized pressures is determined, and also includes a display 35 and a speaker 36, which are capable of outputting an alarm generated in response to a signal sent from the controller 34 when the controller 34 determines that the value detected by the pressurized pressure detecting device 32 lies out of the predetermined range of pressurized pressures.

In the thus-configured water injection type screw compressor 1, because the outflow space 19 is in communication with the low pressure space 22 inside the rotor chamber 3, and the target gas at a pressure higher than that of the low pressure space 22 is introduced into the pressurized space 20, the pressure of the outflow space 19 becomes lower than that of the pressurized space 20. This generates, in the clearance between the first non-contact seal 16 and the rotor shaft 7, a tiny stream of the target gas flowing from the pressurized space 20 to the outflow space 19. Due to the stream, the water discharged from the rotor chamber 3 into the outflow space 19 along with the target gas is prevented from entering the pressurized space 20. In this way, the lip seal 18 can be protected against damage caused by water that reaches the lip seal 18, to thereby block the lubricating oil for the ball bearings 11 from being leaked out.

Meanwhile, the target gas is gradually introduced from the pressurized space 20 through the clearance between the second non-contact seal 17 and the rotor shaft 7 into the open space 21. Because the target gas introduced into the open space 21 is released through the open communicating channels 25 and 26 into the atmosphere, the pressure of the open space 21 is maintained at an atmospheric pressure. Thus, even if water is introduced into the open space 21, for example, while the water injection type screw compressor 1 is stopped, damage which will be inflicted on the lip seal 18 can be kept to a minimum, because the introduced water is released through the open communicating channels 25, 26 into the atmosphere.

Further, in the water injection type screw compressor 1, the alarm device 33 (the controller 34) previously defines a pressure slightly higher than the setting pressure of the pressurized space 20 established by the regulator 30 as an upper limit pressure and a pressure slightly lower than the setting pressure as a lower limit pressure, and determines the range of pressurized pressures composed of normal pressures between the upper limit pressure and the lower limit pressure. Preferably, after a test or other measures is carried out to find pressure variations resulting from breakage of the first non-contact seal 16 or the second non-contact seal 17, a difference between the setting pressure established by the regulator 30 and the upper or lower limit pressure is set to an appropriate value based on the pressure variations.

Note that the pressure $P_1$ detected by the pressurized pressure detecting device 32 might be changed beyond the range of pressurized pressures also by an abnormal condition of the regulator 30. This means that, in the water injection type screw compressor 1, the alarm is generated not only when the abnormal conditions of the first and second non-contact seals 16 and 17 are detected but also when the abnormal condition of the regulator 30 is detected.

Figure 2:
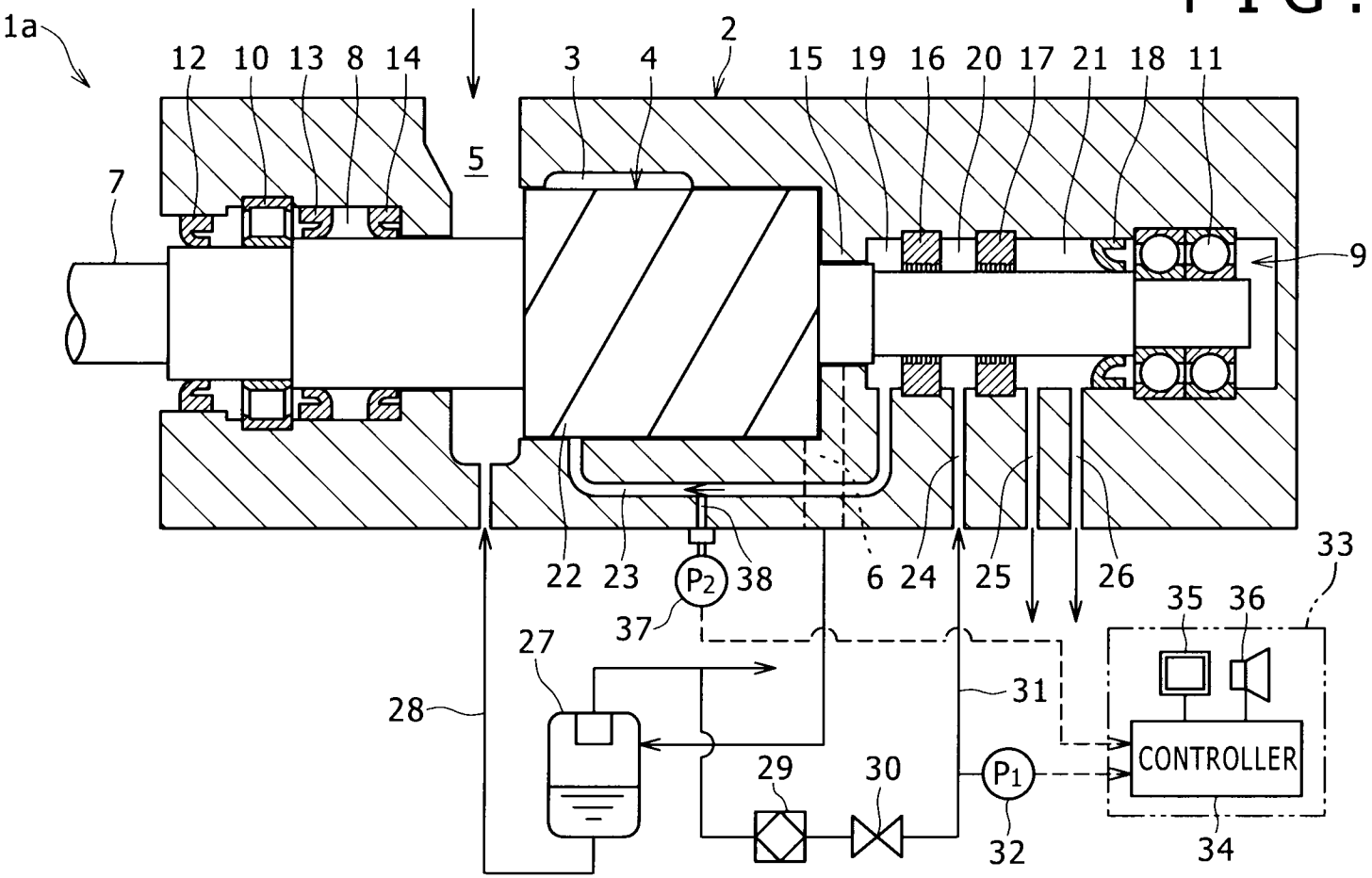
FIG. 2 is a simplified cross sectional diagram of a screw compressor according to a second embodiment of the present invention.

Next, referring to FIG. 2, a water injection type screw compressor 1*a* according to a second embodiment of this invention is shown. It should be noted that, in the embodiments described later, the same components as those in the previous embodiment are designated by the same reference numerals as those of the previous embodiment, and the descriptions related to these components will not be repeated.

The water injection type screw compressor 1*a* of this embodiment includes a low pressure detecting device 37 for detecting a pressure $P_2$ of the low pressure communicating channel 23. To achieve this, the casing 2 is provided with a connecting channel 38, which is communicated with the low pressure communicating channel 23 and extended to an outer surface on which the low pressure detecting device 37 can be attached. The pressure $P_2$ of the low pressure communicating channel 23 detected by the low pressure detecting device 37 is input into the controller 34 in the alarm device 33. The controller 34 calculates a pressure difference $\Delta P$ between the pressure $P_1$ detected by the pressurized pressure detecting device 32 and the pressure $P_2$ detected by the low pressure detecting device 37, and causes the display 35 and the speaker 36 to output the alarm also when the pressure difference $\Delta P$ falls out of a predefined pressure differential range.

Preferably, the pressure differential range defined in the controller 34 is determined based on a range of pressures which are found, by carrying out a test or other measures, to be obtained when actual leakage of water from the first non-contact seal 16 is caused by any abnormal condition that has occurred in the first non-contact seal 16. According to the above-described structure, occurrence of the abnormal condition in the first non-contact seal 16 can be detected in an accurate and reliable way, which can contribute to further reduction in the possibility that the leaked water arrives at the lip seal.

In the water injection type screw compressor 1*a*, graded levels of the above-described "range of pressurized pressures" or "pressure differential range" may be defined in the alarm device 33, and predetermined alarms may be respectively generated by the display 35 or the speaker 36 based on the levels of the "range of pressurized pressures" or "pressure differential range" associated with the pressure $P_1$ detected by the pressurized pressure detecting device 32 or the pressure difference ΔP. In this way, a potential abnormal condition predicted to occur in the regulator 30 in the future (a predicted abnormal condition) or other unusual conditions can be accurately and reliably detected, to thereby prevent the abnormal condition itself from occurring.

Figure 3:
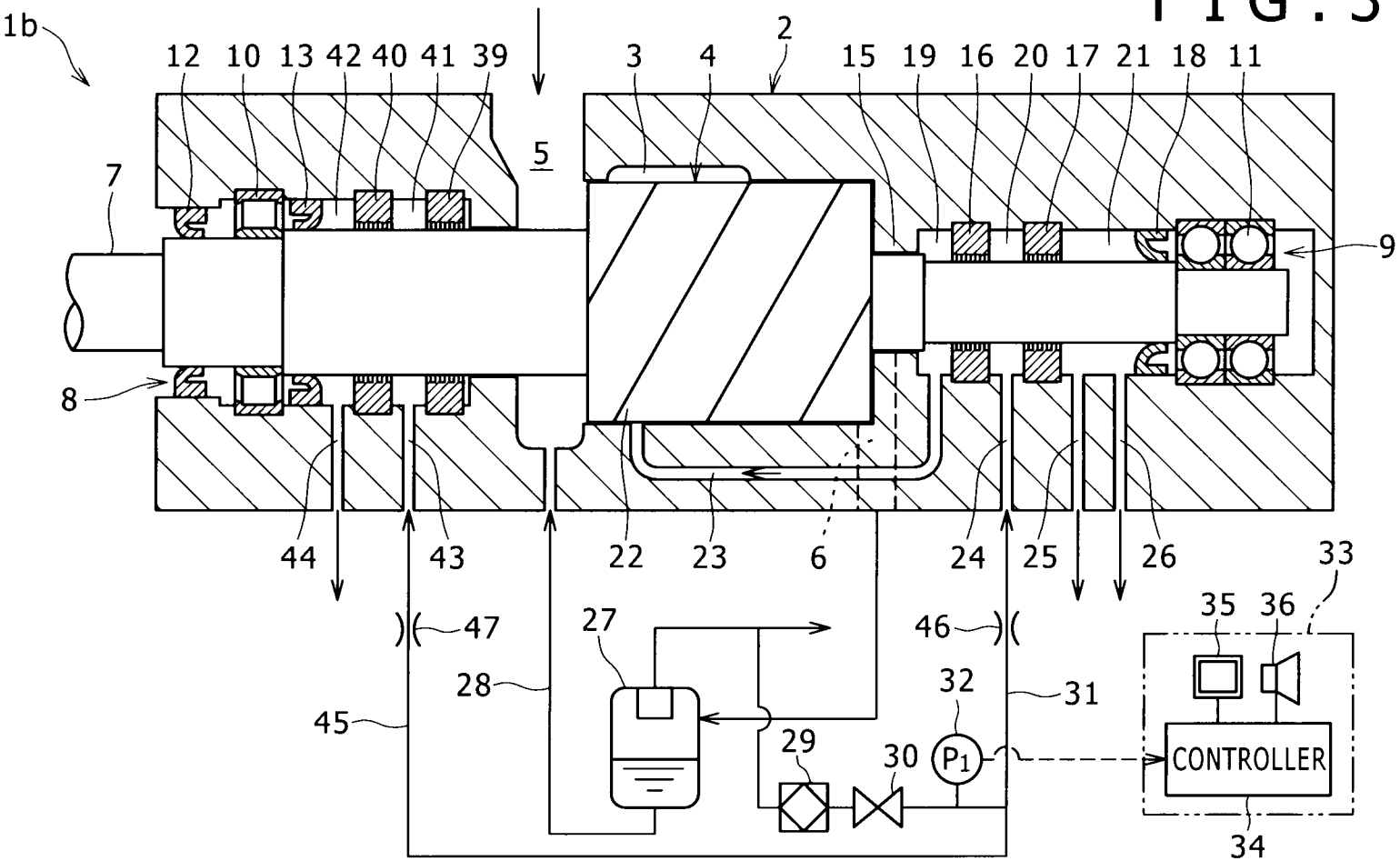
FIG. 3 is a simplified cross sectional diagram of a screw compressor according to a third embodiment of the present invention.

Next, a water injection type screw compressor 1*b* according to a third embodiment of this invention is shown in FIG. 3. In the water injection type screw compressor 1*b* of the third embodiment, a first non-contact seal 39 and a second non-contact seal 40 are disposed in sequence from the rotor chamber 3 side between the rotor chamber 3 and the lip seal 13 for the rotor shaft 7 on the intake side (low pressure side), as in the case of the discharge side (high pressure side). Both the first non-contact seal 39 and the second non-contact seal 40 are also labyrinth seals having the structure similar to those of the first and second non-contact seals 16 and 17 on the high pressure side.

Thus, inside the shaft supporting and sealing space 8 on the low pressure side, a pressurized space 41 is formed between the first non-contact seal 39 and the second non-contact seal 40, while an open space 42 is formed between the second non-contact seal 40 and the lip seal 13. The casing 2 includes a pressurized communicating channel 43 for introducing the target gas at high pressure into the pressurized space 41 and an open communicating channel 44 that communicates with the open space 42 and the outside of the casing 2 so that the open space 42 opens to the atmosphere. The pressurized communicating channel 43 is connected to a pressurized pipe 45, which is branched from the pressurized pipe 31, located downstream of the regulator 30, so as to be provided with the target gas.

Note that an orifice 46 is inserted upstream from the pressurized communicating channel 24 in the pressurized pipe 31, while an orifice 47 is inserted upstream from the pressurized communicating channel 43 in the pressurized pipe 45. Although the pressure of the target gas is slightly decreased through the orifice 46, the pressurized space 20 on the discharge side is supplied with the target gas, which is still at the high pressure. Similarly, the pressurized space 41 on the intake side is also supplied with the target gas, which is slightly reduced through the orifice 47, but still maintained at the high pressure.

Here, in the water injection type screw compressor 1*b*, the pressurized pressure detecting device 32 for detecting the pressure $P_1$ of the pressurized pipe 31 is disposed, in the pressurized pipe 31, downstream of the regulator 30 and upstream of a junction point between the pressurized pipe 31 and the pressurized pipe 45. The water injection type screw compressor 1*b* also includes the alarm device 33 equipped with the controller 34, in which the value detected by the pressurized pressure detecting device 32 is input, and whether or not the detected value lies within the predefined range of pressurized pressures is determined, as well as other components.

According to this embodiment, the pressurized space 41, into which the target gas is introduced to thereby maintain the pressurized space 41 at high pressure, is additionally formed in the shaft supporting and sealing space 8 on the intake side. Thus, even when the pressure of the target gas sucked by the water injection type screw compressor 1*b*, i.e. the pressure of the intake channel 5 is higher than the atmospheric pressure, no target gas is allowed to enter the pressurized space 41. In this way, water entrained in the target gas is not allowed to enter and reach the lip seal 13, thereby preventing the lip seal 13 from getting damaged or preventing the lubricating oil for the bearings from leaking.

In addition, even if water could leak into the pressurized space 41 and thus the open space 42, the leaked water is released from the open space 42 through the open communicating channel 44 to the outside, which can prevent the leaked water from arriving at the lip seal 13 without increasing the pressure of a sealed space to be exerted on the lip seal 13. As a result, the lip seal 13 is protected against damage, and a leak of a lubricating oil for the bearing caused by the entry of water into the lip seal 13 can be avoided.

Also, in the water injection type screw compressor 1*b*, the alarm device 33 (the controller 34) previously defines a pressure slightly higher than the setting pressure established by the regulator 30 as the upper limit pressure and a pressure slightly lower than the setting pressure as the lower limit pressure, and determines the range of pressurized pressures compose of normal pressures between the upper limit pressure and the lower limit pressure. Preferably, after a test or other measures are carried out to find pressure variations resulting from breakage of the first non-contact seal 16 or the second non-contact seal 17 or resulting from breakage of the first non-contact seal 39 or the second non-contact seal 40, the difference between the setting pressure established by the regulator 30 and the upper or lower limit pressure is set to an appropriate value based on the pressure variations.

The present invention is not limited to the above-described structure of the embodiments. For example, the pressurized pressure detecting devices 32 and the low pressure detecting device 37 may be designed in various ways as long as they are basically capable of detecting the pressure of the pressurized space 20 or the pressurized space 41, the pressure of the outflow space 19, or variations in these pressures. Specifically, the pressurized pressure detecting devices 32 may be installed to directly detect the pressure of the pressurized space 20 or the pressurized space 41, or may be installed to detect the pressure of the pressurized communicating channel 24 or the pressurized communicating channel 43. Note that, in order to directly and independently detect the pressures of the pressurized space 20 and the pressurized space 41 to find their respective variations (and thus find whether the first non-contact seal 16 and/or the second non-contact seal 17 on the discharge side is damaged or the first non-contact seal 39 and/or the second non-contact seal 40 on the suction side is damaged, separately), the pressurized pressure detecting devices may be installed, one for the pressurized space 20 and one for the pressurized space 41, with the ranges of pressurized pressures respectively defined for the pressurized space 20 and the pressurized space 41. Meanwhile, the low pressure detecting device 37 may be adapted to directly detect the pressure of the low pressure space 19 or detect the pressure of the low pressure space 22 inside the rotor chamber 3.

Moreover, the low pressure communicating channel 23 may be formed for allowing the outflow space 19 to be communicated with the intake channel 5. In addition, a single-acting, solenoid operated on-off valve of a normally closed type, which is only opened while power is being supplied, may be inserted on a further upstream side with respect to the filter 29 located upstream of the regulator 30, or a dryer maybe disposed downstream of the water recovery unit 27 to introduce the target gas having been dehumidified by the dryer into the pressurized spaces 20, 41 via the pressurized pipes 31, 45 and the pressurized communicating channels 24, 43. As such, various modifications may be made.

What is claimed is:

1. A screw fluid machine of a water injection type, comprising:

a casing in which a rotor chamber is formed;

intermeshing male and female screw rotors housed in said rotor chamber to compress a target gas or convert expansion force of the target gas into turning force;

a water supplying mechanism for injecting water into said rotor chamber to lubricate said screw rotors;

a first non-contact seal, a second non-contact seal, and a lip seal, which are disposed between said rotor chamber and a bearing for a rotor shaft of said screw rotor and in this order from the rotor chamber side; and a pressurized communicating channel for introducing the target gas which is at high pressure into a pressurized space formed between said first non-contact seal and said second non-contact seal.

2. The screw fluid machine according to claim 1, further comprising:

a pressurized pressure detecting device for detecting a pressure of said pressurized space or said pressurized communicating channel, and an alarm device for generating an alarm when a value detected by said pressurized pressure detecting device falls out of a predefined range of pressurized pressures.

3. The screw fluid machine according to claim 1, wherein:

the screw fluid machine is a screw compressor for compressing the target gas;

further comprises a water recovery unit for separating the water from the target gas that is discharged; and supplies the target gas, from which the water is separated in said water recovery unit, through a pressure reducing means to said pressurized communicating channel.

4. The screw fluid machine according to claim 1, wherein:

said bearing is a bearing on the high pressure side, and the screw fluid machine further comprises a low pressure communicating channel for allowing an outflow space, which is formed on the rotor chamber side with respect to said first non-contact seal, to be communicated with a low pressure space inside said rotor chamber or a low pressure channel for the target gas, which is in communication with said rotor chamber.

5. The screw fluid machine according to claim 4, further comprising:

a pressurized pressure detecting device for detecting a pressure of said pressurized space or said pressurized communicating channel;

a low pressure detecting device for detecting a pressure of said low pressure space or said low pressure channel, which is in communication with said outflow space, said low pressure communicating channel, or said low pressure space; and an alarm device for generating an alarm when a pressure difference between a value detected by said pressurized pressure detecting device and a value detected by said low pressure detecting device falls out of a predefined pressure differential range.

6. The screw fluid machine according to claim 1, further comprising an open communicating channel, through which an open space, which is formed between said second non-contact seal and said lip seal, opens to an outside of said casing.

* * * * *